US006102737A

United States Patent [19]

Gohdes

[11] Patent Number: 6,102,737

[45] Date of Patent: Aug. 15, 2000

[54] CONNECTING ELEMENT FOR A COAXIAL HIGH-FREQUENCY CABLE

[75] Inventor: Hartmut Gohdes, Hannover, Germany

[73] Assignee: Alcatel, Paris, France

[21] Appl. No.: 09/252,012

[22] Filed: Feb. 18, 1999

[30] Foreign Application Priority Data

Feb. 19, 1998 [DE] Germany ..... 198 06 906

[51] Int. Cl.[7] ..... H01R 9/05

[52] U.S. Cl. ..... 439/583

[58] Field of Search ..... 439/583, 584, 439/578

[56] References Cited

U.S. PATENT DOCUMENTS

| | | | |
|---|---|---|---|
| 5,154,636 | 10/1992 | Vaccaro et al. | 439/583 |
| 5,595,502 | 1/1997 | Allison | 439/583 |

FOREIGN PATENT DOCUMENTS

| | | | |
|---|---|---|---|
| 0 722 199 A2 | 7/1996 | European Pat. Off. . | |
| 0 741 436 A1 | 11/1996 | European Pat. Off. . | |
| 2 682 819 A1 | 4/1993 | France . | |
| 27 24 862 A1 | 1/1978 | Germany . | |
| 43 09 775 A1 | 9/1994 | Germany . | |
| 00 2277207 | 10/1994 | United Kingdom | 439/578 |

*Primary Examiner*—Gary F. Paumen
*Assistant Examiner*—Briggitte R. Hammond
*Attorney, Agent, or Firm*—Sughrue, Mion, Zinn, Macpeak & Seas, PLLC

[57] ABSTRACT

A connecting element (V) for a coaxial high-frequency cable (K) that has an inner conductor (1), a dielectric (2) that surrounds the inner conductor, and a tubular outer conductor (3) that is concentric to the inner conductor (1). The end of the cable (K) is widened in the shape of a cone to create an encircling contact area. The connecting element (V) comprises a jack (6) with an encircling projection (8) that is designed to make contact with the inner surface of the contact surface (5) of the outer conductor (3), whereby the projection (8) has a conical outer surface, said jack further including a tubular segment (7) that surrounds the outer conductor (3) in the use position. The connecting element also has an axially movable contact sleeve (12), which on one end has an encircling, inner surface that is widened conically and is designed to come into contact with the outer surface of the contact surface (5) of the outer conductor (3). The contact sleeve (12) can be pressed against the contact surface (5) of the outer conductor (3) by a rotating movement of the jack (6). To improve the intermodulation characteristics of the connecting element (V), the outer surface of the contact sleeve (12) is also conical. A compression jack (13) can be pushed over the contact sleeve (12) in the axial direction, with an inner surface that is widened conically and is designed to make contact with the outer surface of the contact sleeve (12), which inner surface can be pressed by the rotating movement of the jack (6) against the contact surface (5) of the outer conductor (3).

3 Claims, 1 Drawing Sheet

CONNECTING ELEMENT FOR A COAXIAL HIGH-FREQUENCY CABLE

This application is based on and claims priority from German Application No. 198 06 906.5 filed Feb. 19, 1998, the disclosure of which is incorporated by reference herein.

BACKGROUND OF THE INVENTION

This invention relates to a connecting element for a coaxial high-frequency cable that has an inner conductor, a dielectric that surrounds the inner conductor and a tubular outer conductor that is oriented concentrically to the inner conductor, whereby the end of the outer conductor is widened in a cone shape to create an encircling contact surface, consisting of a jack with an encircling projection designed to make contact with the inner surface of the contact surface of the outer conductor, and whereby the projection has a conical outer surface, the jack further having a tubular segment that surrounds the outer conductor in the use position, and of an axially movable contact sleeve that on one end has an encircling, conically widened inner surface that is designed to make contact with the outer surface of the contact surface of the outer conductor, whereby the contact sleeve can be pressed by a rotational movement of the jack against the contact surface of the outer conductor (DE 27 24 862 C2).

Such a connecting element is used, for example, to connect a coaxial high-frequency cable—abbreviated "HF cable" below—to a continuing plug-in connection, a HF instrument or for patching with another HF cable. The inner conductors of the HF cable are thereby generally interconnected by means of a pin and a corresponding socket or jack. Frequently there are problems with the connection of the outer conductors of the HF cable, because when sufficient contact is not achieved, intermodulation phenomena can occur. That can lead to the excitation of new frequencies, which can in turn have a disruptive influence on the actual useful signal.

On the connecting element of the prior art described in the above mentioned DE 27 24 862 C2, the bonding of the outer conductor represents an improvement over other designs of the prior art, in spite of its simple construction, by the interaction of the conical projection on the jack and the conical contact sleeve. Nevertheless, disruptive intermodulation phenomena appear.

SUMMARY OF THE INVENTION

The object of the invention is to design the connecting element described above so that intermodulation phenomena can be suppressed to the maximum extent possible by the appropriate bonding of the outer conductor.

To accomplish this object, the invention teaches that the outer surface of the contact sleeve is also conical, and a compression jack that can be pushed in the axial direction over the contact sleeve is attached with a conically widened inner surface that is designed to make contact with the outer surface of the contact sleeve, in which the inner surface can be pushed by the rotational movement of the jack against the contact surface of the outer conductor.

With this connecting element, it is possible, in a very simple manner, to increase the contact pressure on the outer conductor so that these contact parts will no longer cause any intermodulation. When the jack is pulled on as a result of its rotational movement, on the one hand its conical projection and on the other hand the contact sleeve are pressed firmly against the conical contact surface of the outer conductor. The contact is particularly firm and is not restricted by any stop, because the axially movable compression jack is also conical on its end. It therefore transmits the force, acting on it in the axial direction, in its entirety to the contact surface of the outer conductor. This conical contact surface is thereby clamped firmly on both sides. It is pressed against the projection of the jack with a correspondingly high pressure. The transmission resistance between the two parts is thereby extremely low.

Thus, as described below, the invention comprises a connecting element (V) for a coaxial high-frequency cable (K) that has an inner conductor (1), a dielectric (2) that surrounds the inner conductor, and a tubular outer conductor (3) that is concentric to the inner conductor (1). The end of the cable (K) is widened in the shape of a cone to create an encircling contact area. The connecting element (V) comprises a jack (6) with an encircling projection (8) that is designed to make contact with the inner surface of the contact surface (5) of the outer conductor (3), whereby the projection (8) has a conical outer surface, the jack further including a tubular segment (7) that surrounds the outer conductor (3) in the use position. The connecting element also has an axially movable contact sleeve (12), which on one end has an encircling, inner surface that is widened conically and is designed to come into contact with the outer surface of the contact surface (5) of the outer conductor (3). The contact sleeve (12) can be pressed against the contact surface (5) of the outer conductor (3) by a rotating movement of the jack (6). To improve the intermodulation characteristics of the connecting element (V), the outer surface of the contact sleeve (12) is also conical. A compression jack (13) can be pushed over the contact sleeve (12) in the axial direction, with an inner surface that is widened conically and is designed to make contact with the outer surface of the contact sleeve (12), which inner surface can be pressed by the rotating movement of the jack (6) against the contact surface (5) of the outer conductor (3.

BRIEF DESCRIPTION OF THE DRAWING

One exemplary embodiment of the invention is illustrated in the accompanying drawings, in which.

DETAILED DESCRIPTION OF THE INVENTION

Figure 1:
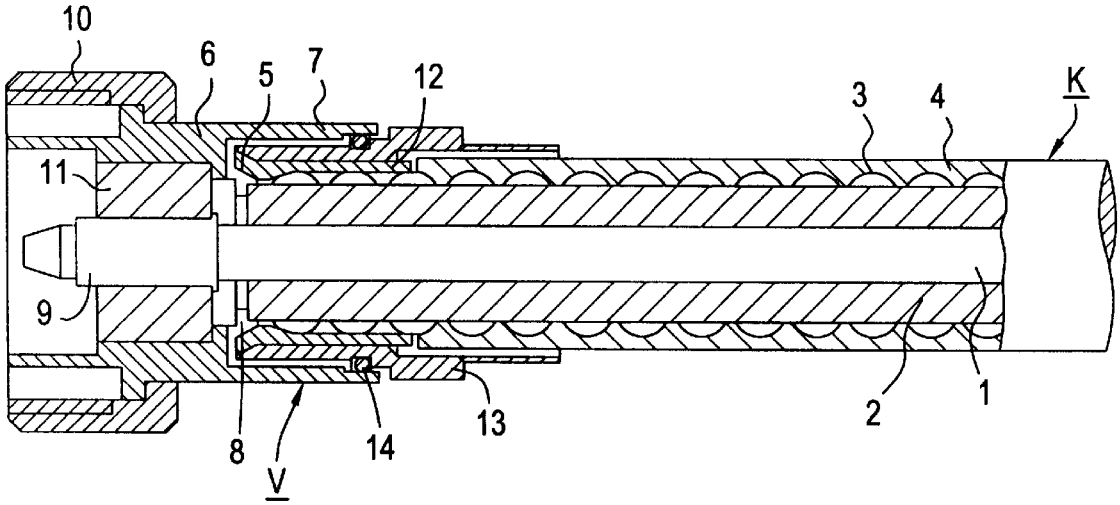
FIG. 1 illustrates an overall view of a connecting element according to the present invention.

FIG. 1 shows the end of a coaxial HF cable on which is attached the connecting element V that is used to make the electrical interconnection. The HF cable K has an inner conductor 1, a dielectric 2 that surrounds the inner conductor, and a tubular outer conductor 3 that is concentric to the inner conductor 1. A plastic jacket 4 is applied over the outer conductor 3. The outer conductor 3 is in contact with the dielectric 2. In the illustrated exemplary embodiment, the outer conductor 3 has a corrugated shape, i.e., it bends easily. The end of the outer conductor 3 is widened in a conical shape to form an encircling contact surface 5.

A jack that is made of a material that is a good electrical conductor is attached over the end of the HF cable. The jack surrounds the outer conductor 3 with a tubular segment 7 from outside. Concentric with the tubular segment 7, the jack 6 has an encircling projection 8 that projects axially and has a conical outer surface, which is designed to make contact with the inner surface of the contact surface 5 of the outer conductor 3. The corresponding assembly position is illustrated in FIG. 1. The connecting element V also includes a central connecting pin 9 to make contact with the inner conductor 1 and a union nut 10. The contact pin 9 is fixed centrally in the union nut 10 by a supporting washer 11 that is made of insulating material.

Figure 2:
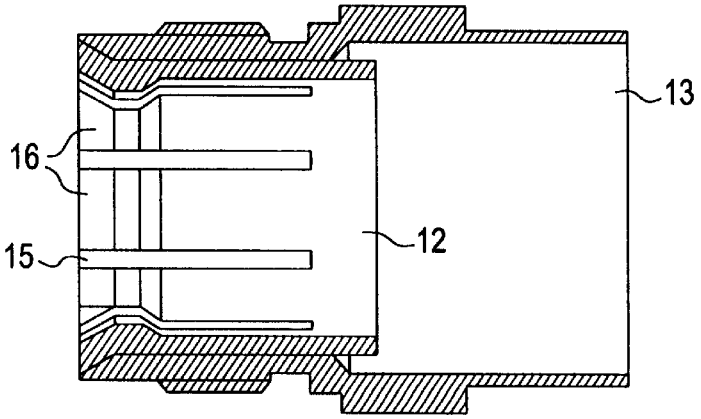
FIG. 2 shows an enlarged detail from FIG. 1.

Located over the outer conductor 3 are also a contact sleeve 12 and a compression jack 13, which are also part of the connecting element V. The construction of the contact sleeve 12 and the compression jack 13 are illustrated in greater detail in FIG. 2. The compression jack 13 can be displaced in the axial direction on the HF cable K or on its outer conductor 3. The compression jack 13 can be realized in one piece, as illustrated in the accompanying drawing, but it can also consist of two parts axially next to one another. The compression jack 13 is connected to the jack 6 or its tubular segment 7 by a threaded connection, and can thus be screwed onto it. An encircling gasket 14 can be installed between the tubular segment 7 and compression jack 13.

The dimensions of the contact sleeve 12 are coordinated with the outside dimensions of the outer conductor 3. Its one end is also widened in a conical shape so that it matches the conical contact surface 5 of the outer conductor 3. On this end, the contact sleeve 12 is preferably divided all the way around into spring arms 16 by slots 15 that run axially. The external surface of the contact sleeve 12 is also widened conically on its inside conical end. It serves as the contact surface for the compression jack 13, which is also conically widened on its corresponding end. The inside diameter of the compression jack 13 is approximately equal to the outside diameter of the contact sleeve 12, so that the compression jack 13 is guided through it in the axial direction.

The connecting element V can be assembled as follows, for example:

The HF cable K is stripped of the jacket 4 on its end. Then the outer conductor 3 and the dielectric are shortened, so that the inner conductor 1 projects outward to make good contact. When the inner conductor 1 is tubular, this step can be omitted if the contact pin 9 can be inserted into the inner conductor 1. Then the contact sleeve 12 and the compression jack 13 are pushed over the outer conductor 3 and moved into the assembly position. Then the end of the outer conductor 3 can be deformed using a crimping tool, for example, to create the conical contact surface 5. Then the jack 6 with the union nut 10 and the contact pin 9 are pushed in the axial direction onto the end of the HF cable K. The contact jack 6 is moved until its projection 8 comes into contact with the inner surface of the contact surface 5 of the outer conductor 3. Then the compression jack 13 is screwed into the tubular segment 7 of the jack 6. In its final assembled position, the compression jack 13 presses against the contact sleeve 12.

What is claimed is:

1. A connecting element for a coaxial high-frequency cable that has an inner conductor, a dielectric that surrounds the inner conductor and a tubular outer conductor that is concentric to the inner conductor, whereby an end of the outer conductor is widened in a cone shape to create an encircling contact surface, said connecting element comprising a jack that has (i) an encircling projection with a conical outside surface that is designed to come into contact with an inner surface of the contact surface of the outer conductor, and (ii) a tubular segment that surrounds the outer conductor in a operating position, and said connecting element further including an axially movable contact sleeve that on one end has an encircling inner surface that is widened in a shape of a cone and is designed so that it comes into contact with the outside surface of the contact surface of the outer conductor, whereby the contact sleeve can be pressed by a rotational movement of the jack against the contact surface of the outer conductor, characterized in that:

the outside surface of the contact sleeve (12) also is conical, and a compression jack (13) that surrounds the contact sleeve (12), the compression jack having a conically widened inner surface and being movable in the axial direction, the conically inner surface of the compression jack (13) being designed to make contact with the outer surface of the contact sleeve (12), wherein said inner surface of said compression jack can be pressed by the rotational movement of the jack (6) against the contact surface (5) of the outer conductor (3).

2. The connecting element as claimed in claim 1, characterized in that the contact sleeve (12) is divided on its conical end all the way around into spring arms (16) by slots (15) that run axially.

3. The connecting element as claimed in claim 1 or 2, characterized in that the compression jack (13) consists of two parts lying axially next to one another.

* * * * *